United States Patent [19]

Harris et al.

[11] Patent Number: 4,887,789

[45] Date of Patent: Dec. 19, 1989

[54] FORM FOR MOLDING COLUMNS

[76] Inventors: Frank R. Harris, 18922 Crest Ave., Castro Valley, Calif. 94546; Robert D. Young, 107 Reservoir Rd., Atherton, Calif. 94025

[21] Appl. No.: 186,513

[22] Filed: Apr. 26, 1988

[51] Int. Cl.[4] ..... E04G 13/02

[52] U.S. Cl. ..... 249/16; 249/48; 249/51; 249/134; 249/164; 249/219.1

[58] Field of Search ..... 249/16, 17, 48, 49, 249/50, 51, 61, 112, 134, 143, 150, 153, 164, 173, 179, 183, 219.1

[56] References Cited

U.S. PATENT DOCUMENTS

| | | | |
|---|---|---|---|
| 1,224,584 | 5/1917 | Vogan | 249/48 |
| 1,299,739 | 4/1919 | Landwehr | 249/48 |
| 3,255,990 | 6/1966 | Williams | 249/48 |
| 3,301,926 | 1/1967 | Reiland | 249/48 |
| 3,490,577 | 1/1970 | Girikscheit | 249/134 |
| 3,539,144 | 11/1970 | Krug | 249/134 |
| 3,751,196 | 8/1973 | Cannon et al. | 425/4 |
| 3,844,527 | 10/1974 | Scott | 249/189 |
| 3,848,040 | 11/1974 | Confer et al. | 249/134 |
| 3,956,437 | 5/1976 | Ellis | 249/49 |
| 3,974,996 | 8/1976 | Violet | 249/173 |
| 3,990,672 | 11/1976 | Buchanan | 249/48 |
| 4,017,051 | 4/1977 | Scott et al. | 249/134 |
| 4,767,095 | 8/1988 | Fitzgerald et al. | 249/134 |

FOREIGN PATENT DOCUMENTS

| | | | |
|---|---|---|---|
| 743446 | 6/1970 | Belgium | 249/134 |
| 2061272 | 6/1972 | Fed. Rep. of Germany | 249/134 |
| 3121418 | 12/1982 | Fed. Rep. of Germany | 249/48 |
| 8300841 | 10/1984 | Netherlands | 249/134 |

OTHER PUBLICATIONS

*Burke Catalog No.* 870, Field Ed., April, 1987, San Mateo, Calif.; pp. 55–60.

*Primary Examiner*—James C. Housel
*Attorney, Agent, or Firm*—Townsend and Townsend; 15

[57] ABSTRACT

The present invention relates to a form for molding building components, such as columns, having a desired size, shape, and surface features from solidifying building materials such as concrete. The form is sculpted from a plastic material such as polystyrene or urethane. The cylinder is hollowed so that the interior of the resulting form has the size, shape, and surface features of the desired building component.

9 Claims, 4 Drawing Sheets

FORM FOR MOLDING COLUMNS

BACKGROUND OF THE INVENTION

1. Field of the Invention

The present invention relates to forms for molding columns and more particularly to a form for molding columns of any desired size, shape and surface design from solidifying materials such as concrete. The present invention also relates to a method for constructing the form.

2. Description of the Prior Art

Concrete columns are often used for support in buildings, bridges, and many other types of structures. These columns are generally formed by constructing a form or placing a preconstructed form in the desired location of the finished column, inserting metal rods or steel wire mesh in the form, pouring concrete into the form, and removing the form after the concrete has hardened. The metal rods and steel wire mesh are used to provide structural reinforcement for the column. However, such reinforcement is generally not needed if the column is molded around an I-beam.

The majority of concrete columns are molded by using spirally wrapped paper or cardboard tubes as forms. The resulting columns are of a uniform circular cross sectional shape. However, the paper tubes are not reusable because they are destroyed in the process of stripping them from the surface of the formed column. In addition, the paper tubes leave spiral relief marks on the column surface requiring additional labor to remove them. Furthermore, paper tubes cannot be used to mold a column around an I-beam unless the tube can be slipped over the I-beam.

Often concrete columns are molded by using a form constructed from wood. However, constructing wood forms is a labor intensive process. Also, due to the linear nature of wood, the forms and the resulting columns are generally rectangular. In addition, unless the wood is pretreated, the column will generally retain wood grain relief marks on its surface requiring additional labor to remove them.

Although circular or rectangular columns meet structural requirements, it is frequently desirable to provide concrete columns having other shapes and surface features for aesthetic effect. For example, it may be often desirable to create concrete columns that are oval, fluted, or have a brickwork surface.

U.S. Pat. No. 3,751,196 teaches an apparatus for manufacturing a concrete column form. The resulting manufactured form has a paper tube exterior for support and a polystyrene interior for forming a column with the desired size and cross-sectional shape. Columns with a multitude of cross-sectional shapes, such as oval, fluted, and polygonal, can be molded with a form created by this apparatus. However, this form cannot be used to mold a column around an I-beam unless the form can be slipped over the I-beam. In addition, this apparatus requires extensive set-up labor and materials for each size and shape of column to be formed.

Before manufacturing a form as taught by the aforementioned patent, a metal mandrel must be constructed with the same dimensions as the desired column. For example, if a fluted column is desired, then a fluted mandrel of the same dimensions must be constructed. If a second fluted column is desired with different dimensions such as diameter, then a second mandrel must be constructed. In addition, each mandrel must contain internal channels for allowing the flow of heating and cooling fluid or gas.

Once the mandrel is complete, it is inserted into an assembly for the manufacture of the form. The assembly holds the paper tube, lowers it over the mandrel, encloses the ends, then inserts an expandable plastic such as polystyrene beads into the enclosed space between the paper tube and the mandrel. A catalyst or other reactant is added, and the plastic is heated or cooled by fluid-filled channels. Once the plastic has hardened the mandrel is removed, thereby making the form ready for pouring of concrete or other material.

Although columns can be molded with forms constructed by this apparatus, the apparatus is cumbersome and limited. In addition to the expensive set-up required, the apparatus is limited to columns that have a uniform cross-section. That is, because of the process of pulling the mandrel from the molded plastic form, neither the form nor the mandrel can have horizontal relief patterns dependent on column height. For example, the apparatus cannot produce forms that would cast a column with a brickwork designed pattern surface pattern. If such a form were produced, the protruding simulated grout lines would be scrapped off the pattern by the mandrel during the process of removing the the mandrel from the form. Furthermore, these forms are not reusable because they are destroyed during removal from the cast column.

SUMMARY OF THE INVENTION

The present invention relates to forms for molding building components, such as columns, having a desired size, shape, and surface features from solidifying building materials such as concrete. In one embodiment the form is sculpted from a single plastic cylinder or from two or more pieces which fit together to make a cylinder. Preferably, the plastic is polystyrene, urethane, or styrofoam (foamed polystyrene). The cylinder or cylinder components are hollowed so that the interior of the resulting form has the size, shape, and surface features of the desired building component. If the exterior of the form is cylindrical, it can be sized to fit within well-known cylindrical cardboard tubes. Alternatively, other exterior shapes may be employed for other support structures. The present invention comprises the form and the method of constructing the form.

The form is sculpted from a fabricated plastic cylinder or block. The properties of plastic make it easy to sculpt with heat, pressure, or shear. Yet it is strong, light, durable, and relatively inert. The form is relatively inexpensive to manufacture, yet can withstand the stresses and chemical reactions expected in molding concrete columns. The form can be produced at short notice and its light weight enables the form to be economically and easily delivered to a local or even distant job site. In addition, the form leaves a uniform finish on the column, reducing labor and materials required to dress the columns.

The shaping or forming of the plastic form can be accomplished by several well established methods such as a hot wire, a water jet, a laser, or various machining tools. Because the form interior can be sculpted with a variety of tools, there is no restriction to having an interior with a uniform cross-section. For example, the plastic cylinder can be hollowed so the form will create a column with a brickwork surface with indented joints, a bulging middle, or a spiral indentation.

The form can be cut into at least two connecting parts prior to or after molding. This allows the form to be easily and more quickly removed from a hardened column. This also allows the form to be used to mold a column around an I-beam. The exterior surface of the form can be coated with a hardening agent to increase the number of times the form can be used and to increase the overall strength of the form. In addition, the inferior of the form can be coated with a releasing agent to aid in the removal of the form from the hardened concrete column, reducing the time and cost of stripping.

The exterior of the form can be channeled to accept and equally distribute about the exterior of the form multiple supporting members such as wooden braces. This strengthens the form, allowing it to be used without a cylindrical cardboard supporting tube. Restraining means, such as cables, metal or plastic bands, surround the form and the supporting means to provide rigidity. This prevents the form parts and the supporting means from separating from each other during use, and enables tall columns to be cast. Pads can be placed between the restraining means and the form or between the restraining means and the supporting members. The pads prevent damage to the form or the supporting means and prevent slippage of the restraining means.

For a further understanding of the nature and advantages of the invention, reference should be had to the ensuing detailed description taken in conjunction with the accompanying drawings.

DETAILED DESCRIPTION OF THE PREFERRED EMBODIMENTS

Figure 1:
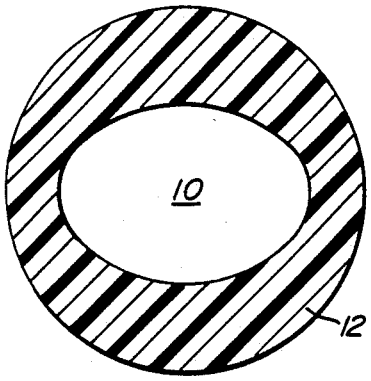
FIGS. 1, 2, and 3 are a cross-sectional view of various shapes that can be sculpted in plastic cylindrical forms according to the present invention.
Figure 2:
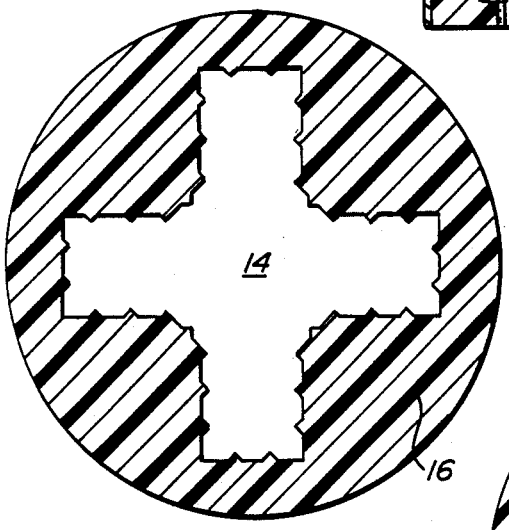
Figure 3:
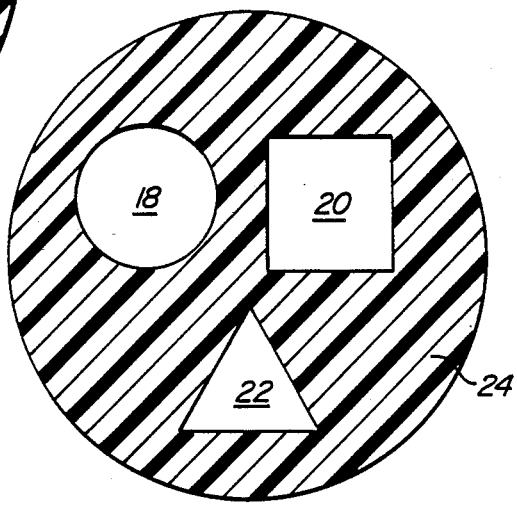

Each of FIGS. 1, 2, and 3 a cross-sectional view of a shape that can be sculpted in plastic cylindrical forms according to the present invention. Shown in FIGS. 1 and 2 are an oval 10 and a fluted cross 14 sculpted through the interior of a cylindrical form 12 and a cylindrical form 16. Also shown in FIG. 3 is a combination of a circle 18, a square 20, and a triangle 22 sculpted into a single cylindrical form 24.

Figure 4:
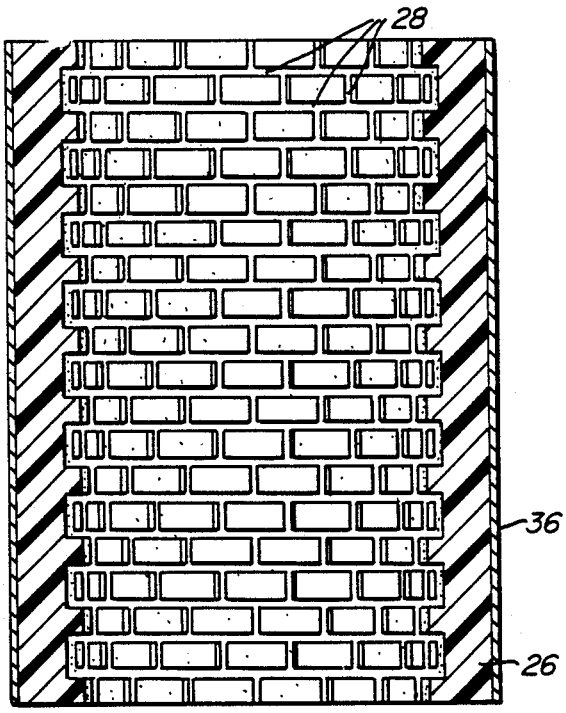
FIGS. 4 and 5 are a side cut-away view and a cross-sectional view of a brickwork pattern sculpted in a form according to the present invention.
Figure 5:
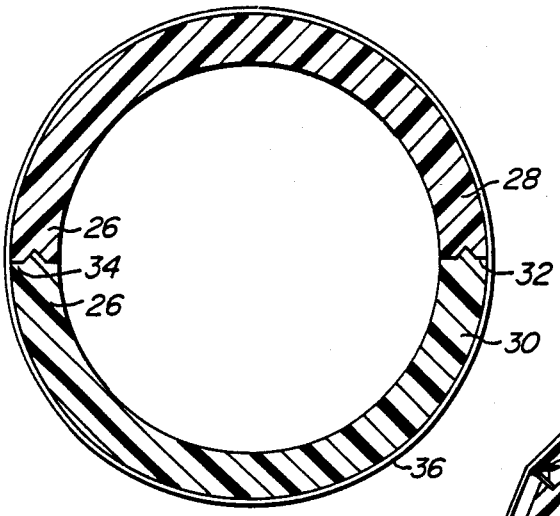

FIGS. 4 and 5 are a side cut-away view and a cross-sectional view of a brickwork pattern sculpted in a form according to the present invention. FIG. 4 shows the brickwork pattern sculpted into the interior of a form 26. The pattern has indentions 28 that simulate the grout lines of brick laid in rows in a circle. FIG. 5 shows the same form 26 with two connecting halves 28 and 30. The two halves are fitted together with key joints 32 and 34. Also shown is a restraining means 36, such as a paper tube or metal strap, encircling the exterior of the form.

In use, the assembled form is placed upright in the desired location of a finished column. Metal rods, steel wire mesh, or other reinforcing means are generally positioned within the form. The form is usually stabilized with cables, rope, or other means to prevent movement. The bottom opening of the form is sealed, for example, by being placed on a footing to prevent leakage of concrete. Concrete or other solidifying material is poured into the top of the form, filling the form to the desired height. Once the concrete has hardened and cured to the desired extent, the restraining means is removed from the form, and the two halves of the form are separated from the cast column which will have a brickwork pattern surface.

Figure 7:
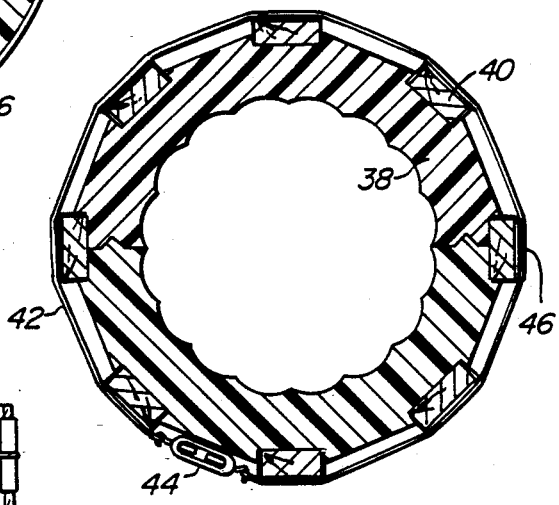
FIGS. 6 and 7 are a side cut-away view and a cross-sectional view of a fluted column sculpted in a form according to the present invention.
Figure 6:
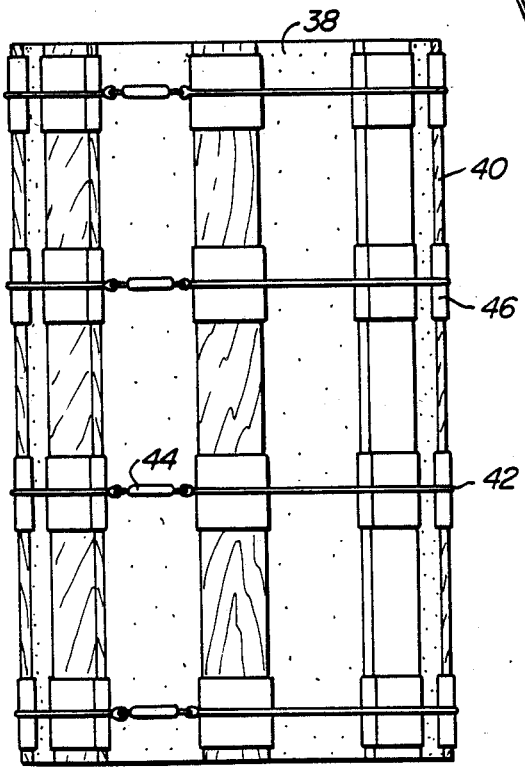

FIGS. 6 and 7 are a side cut-away view and a cross-sectional view of a fluted column sculpted in a form according to the present invention. Both Figures show a channeled form 38 with wooden braces 40, cables 42, cable turnbuckles 44, and pads 46. The wooden braces provide vertical strength for the form. The cables prevent the braces and the form parts from separating under the hydraulic pressure of the concrete. The cable tighteners 44 allow the user to adjust each of the cables to the appropriate tension. The pads prevent the cables from damaging the braces and prevent the cables from slipping downward. Additional timbers or cables may be secured to the wooden braces, cables, or pads for locating and anchoring the form to the proper location.

Figure 10:
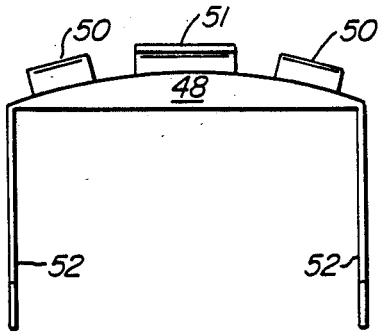
FIGS. 8, 9, and 10 are a side, face, and vertical views of the pads shown in FIGS. 6 and 7.
Figure 8:
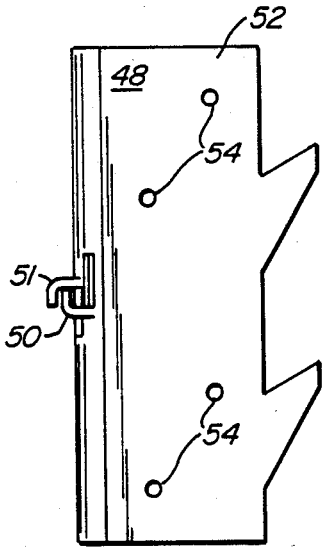
Figure 9:
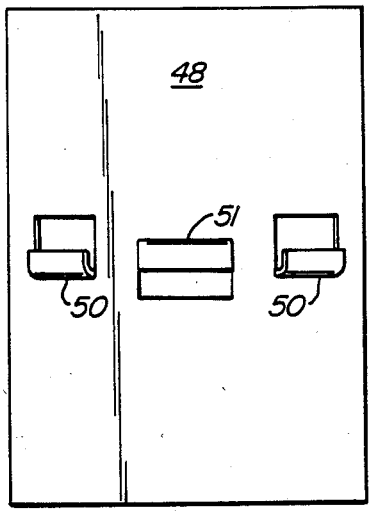

FIGS. 8, 9, and 10 are a side, face, and vertical views of the pads shown in FIGS. 6 and 7. All the Figures show a pad 48 with two upward teeth 50 and a downward tooth 51. Held between the upward and downward teeth, the cable is prevented from slipping up or down. Also shown are flanges 52 with openings 54 for nailing or screwing the pads to the wooden braces.

Figure 11:
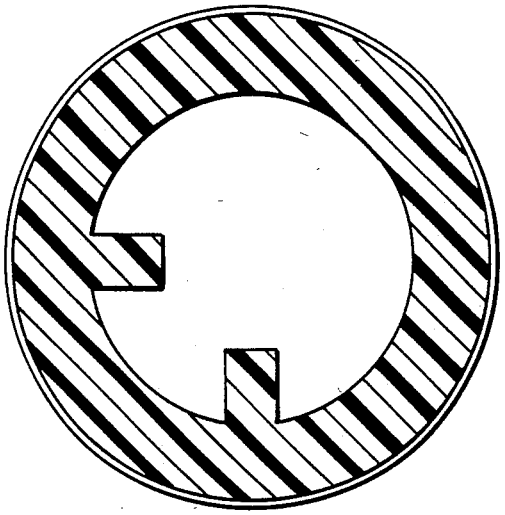
FIGS. 11 and 12 are a cross-sectional view of a side column and a corner column for accommodating precast side walls sculpted in a form according to the present invention.
Figure 12:
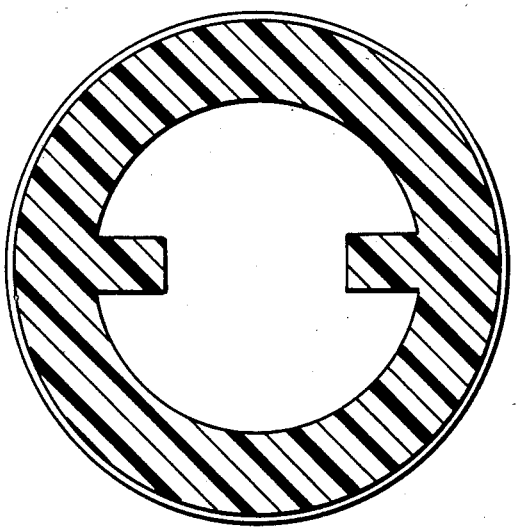

FIGS. 11 and 12 are a cross-sectional view of a wall column and a corner column for accommodating precast side walls. Of course, the columns may be sculpted according to the present invention. Both Figures show circular columns with indentations for inserting side walls sculpted in the forms. These columns can be formed at the factory for constructing prefabricated buildings that are put together at the construction site.

While the above description provides a full and complete disclosure of the preferred embodiments of the invention, various modifications, alternate constructions and procedures, and equivalents may be employed. For example, the method can be used to manufacture forms for beams or other types of building components. Alternative solidifying substances such as cement, stone and mortar, or plaster can be used for forming columns. In addition, the forms do not require two open ends. Either end could be sealed to prevent leakage of cement. Accordingly, the above description and illustration should not be construed as limiting the scope of the invention, which is defined by the appended claims.

What is claimed is:

1. A form for casting a building component of desired size, shape and surface features from castable material comprising:

a plastic material having an open interior volume of the desired size, shape and surface features, the interior volume being defined by the plastic material extending from an exterior surface to an interior surface defining the interior volume, directly against which the castable material is disposed without an intervening layer, the exterior surface receiving supporting means for maintaining the form in a desired position;

supporting means for maintaining the form in the desired position, which comprises a plurality of supporting members, and the exterior surface of the plastic material includes a corresponding plurality of channels receiving the supporting members;

at least one tightenable band surrounding the exterior surface of the plastic material and the supporting members;

means for tightening the tightenable band; and retaining pads disposed between the tightenable band and the supporting members.

2. A form as in claim 1 wherein each of the pads comprises:

a channel-shaped member having an interior surface fitting the supporting members and an exterior surface retaining the tightenable band.

3. A form as in claim 2 wherein the exterior surface of each pad comprises:

at least two opposed protrusions for preventing movement of the tightenable band.

4. A form for casting a building component of desired size, shape and surface features from castable material comprising:

a plastic material having an open interior volume of the desired size, shape and surface features, the interior volume being defined by the plastic material extending from an exterior surface to an interior surface defining the interior volume, directly against which the castable material is disposed without an intervening layer, the exterior surface receiving supporting means for maintaining the form in a desired position;

wherein the supporting means comprises supporting members;

the exterior surface includes a plurality of channels receiving the supporting members;

at least one tightenable band surrounding the supporting members but spaced therefrom by retaining pads; and means for tightening the tightenable band.

5. A form as in claim 4 wherein each of the pads comprises:

a channel-shaped member having an interior surface fitting the supporting members and an exterior surface retaining the tightenable band.

6. A form as in claim 5 wherein the exterior surface of each pad comprises:

at least two opposed -protrusions for preventing movement of the tightenable band.

7. A form for casting a building component of desired size, shape and surface features from castable material comprising:

a plastic material having an open interior volume of the desired size, shape and surface features, the interior volume being defined by the plastic material extending from an exterior surface to an interior surface defining the interior volume, directly against which the castable material is disposed without an intervening layer, the exterior surface receiving supporting means for maintaining the form in a desired position;

the supporting means comprises a plurality of supporting members;

the exterior surface of the plastic material includes a corresponding plurality of channels receiving the supporting members;

at least one tightenable band surrounding the exterior surface of the plastic material and the supporting members;

means for tightening the tightenable band; and retaining pads disposed between the tightenable band and the supporting members.

8. A form as in claim 7 wherein each of the pads comprises:

a channel-shaped member having an interior surface fitting the supporting members and the exterior surface retaining the tightenable band.

9. A form as in claim 8 wherein the exterior surface of each pad comprises:

at least two opposed protrusions for preventing movement of the tightenable band.

* * * * *